US005388430A

United States Patent [19]

Essig

[11] Patent Number: 5,388,430

[45] Date of Patent: Feb. 14, 1995

[54] METHOD OF PRODUCING A FASHIONED, ONE-PIECE FLAT KNITTED ARTICLE FOR A GARMENT PROVIDED WITH SLEEVES

[75] Inventor: Horst Essig, Hülben, Germany

[73] Assignee: H. Stoll GmbH & Co., Reutlingen, Germany

[21] Appl. No.: 103,437

[22] Filed: Aug. 6, 1993

[30] Foreign Application Priority Data

Aug. 26, 1992 [DE] Germany ..... 4228408

[51] Int. Cl.[6] ..... D04B 7/30

[52] U.S. Cl. ..... 66/64; 66/176

[58] Field of Search ..... 66/64, 175, 176, 171, 66/65, 189

[56] References Cited

U.S. PATENT DOCUMENTS

| | | | |
|---|---|---|---|
| 3,407,632 | 10/1968 | Ide | 66/176 |
| 3,668,901 | 6/1972 | Betts et al. | 66/176 |
| 3,685,316 | 8/1972 | Robinson et al. | 66/64 |
| 3,796,068 | 3/1974 | Betts et al. | 66/176 |
| 4,192,156 | 3/1980 | Kohler | 66/64 |
| 4,724,685 | 2/1988 | Stoll et al. | 66/64 |
| 5,214,941 | 6/1993 | Essig | 66/175 |
| 5,275,022 | 1/1994 | Stoll et al. | 66/64 X |

FOREIGN PATENT DOCUMENTS

| | | | |
|---|---|---|---|
| 244774 | 4/1987 | Germany | 66/64 |
| 3939584 | 6/1991 | Germany . | |
| 4027606 | 3/1992 | Germany . | |
| 194154 | 10/1985 | Japan | 66/176 |
| 2183264 | 6/1987 | United Kingdom | 66/176 |

OTHER PUBLICATIONS

Melliand Textberichte, vol. 73, No. 8, Aug. 1992; pp. 642–644.

*Primary Examiner*—Clifford D. Crowder
*Assistant Examiner*—John J. Calvert
*Attorney, Agent, or Firm*—Michael J. Striker

[57] ABSTRACT

A method of producing a fashioned, one-piece flat knitted article for a garment includes knitting several knitted article parts having a front part, a rear part and two sleeves separately and sequentially so that in each knitted article part always several loop rows are knitted in accordance with a pattern for said each knitted article part before transferring to a next knitted article part, knitting the front part and a shoulder region of any shape and pattern after finishing the sleeves with the formation of an arbitrarily shaped neck opening between the front part and the rear part, transferring connecting rows of the sleeves in a loop-like manner inwardly in a direction of the shoulder region and the front and rear parts until sleeve connecting edges are completely turned inwardly relative to the front part and rear part, and subsequently finally knitting a last knitted article part in correspondence with a pattern for said last knitted article part.

14 Claims, 4 Drawing Sheets

METHOD OF PRODUCING A FASHIONED, ONE-PIECE FLAT KNITTED ARTICLE FOR A GARMENT PROVIDED WITH SLEEVES

BACKGROUND OF THE INVENTION

The present invention relates to a method of producing a fashioned, one-piece flat knitted article for a garment provided with sleeves.

More particularly, it relates to such a method in accordance with which the fashioned, one-piece flat knitted article is produced on a two-bed flat knitting machine with at least one carriage, a needle bed displacement device, a loop transfer device, and a patterning device, wherein the individual parts of the knitted article are knitted with special thread guides.

Several such methods for producing one-piece knitted articles for garments are known. For example, the German document DE-OS 40 27 606 discloses a method of producing a garment with sleeves, in accordance with which one or several knitted parts, such as sleeves and a front part, are knitted simultaneously with special thread guides, or in other words, all parts of a common loop row are produced for one loop row. The utilization of separate thread guides permits in a broad periphery a different patterning of the sleeves when compared with the patterning of the body parts. A completely arbitrary and different jacquard patterning of each or both sleeves and the body parts is not possible with this method. Moreover, the above-mentioned method is limited to the production of knitted articles with directly inserted sleeves.

SUMMARY OF THE INVENTION

Accordingly, it is an object of the present invention to provide a method in which an independent jaquard patterning of all knitted parts as well as the formation of arbitrary sleeve shapes and in particular sleeve ends is possible.

In keeping with these objects and with others which will become apparent hereinafter, one feature of the present invention resides, briefly stated, in a method of producing a fashioned, one-piece flat knitted article, in accordance with which first several knitted parts, for example, front parts and both sleeves are knitted separately and sequentially so that for each knitted part always several loop rows are needed after the patterning provided for these parts, before transferring to a next knitted part, after finishing of the sleeves the front part and a shoulder region of any shape and pattern are knitted with the formation of an arbitrarily shaped neck opening between the front part and a rear part, and the closing rows of the sleeves are transferred inwardly in the direction of the shoulder region and the body parts until the sleeve closing edges are completely turned inwardly relative to the body parts, and subsequently the last knitted part, for example, the rear part, is finally knitted in correspondence with the provided patterning.

When the method is performed in accordance with the present invention for each knitted part, different jaquard patterns can be provided. The individual parts are knitted over several loop rows until a pre-determined pattern unit is finished before transfer to the next knitted part. Because of this sequential working of the individual knitted parts, all possible patterns can be produced in the individual knitted parts without jeopardizing the uniformity of the loop formation. Moreover, in accordance with the present invention an arbitrary neck opening can be produced, such as for example a round neck cutout or a V-shaped cutout. Also, knitting-on of the roll collars or stiff collars is possible. In the shoulder part the shoulder seam can be emphasized or reinforced by a pattern to obtain the action of a sewn-in shoulder-band. The production of the whole knitted article is possible with a single carriage. For formation of an upper sleeve connection extending through one or several loop rows in a pattern, for example a piping and/or for forming an arm sphere or the like, the sleeves alone can be further knitted, while on the front parts no loop formation is performed. Thereby a garment with arbitrary sleeve shapes can be produced.

With the spike technique it is possible to form for example arm spheres or also raglan sleeves. Or, pipes extending over one or several loop rows can be knitted as applications on the upper sleeve connection.

When the carriage moves over the needle region for the front part without knitting its loops, advantageously a needle bed displacement can be performed so as to substantially reduce the knitting time. For formation of arm openings in a front part, for example for receiving an arm sphere, first the loops of the sleeve which is closed with a left loop row are transferred to the second needle bed, then a displacement of the second needle bed relative to the first needle bed about a needle pitch in the direction of the front part is performed, the outermost loop of the sleeve facing the front part is transferred to the needle with the outermost loop of the front part and linked together with it and again transferred to the second needle bed, and this process is repeated frequently until the front part is reduced to the desired number of loops. Thereby a reduction of the loop number of the front part and simultaneously a transfer of the sleeve onto the front part is possible.

Advantageously, the knitting of the individual knitted parts can be performed with intarsia thread guides. The use of normal thread guides is also possible; however with the intarsia thread guides a withdrawal of the thread guide from the knitting region after use can be dispensed with. With the intarsia technique, letter structures, company logos, labels and the like can be directly knitted together. Moreover, the knitted part ends can be provided with loop-fixed edges.

With the method in accordance with the present invention it is possible to produce a series of knitted articles. The knitted articles exhibit a uniform quality over all knitted parts since their production is performed from one yarn lot. There is no cutting refuse. After removal from the knitting machine only two seams connecting the front part and the rear part with one another must be made through the shoulder hole and the sleeves on the lower side to obtain a finished garment.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
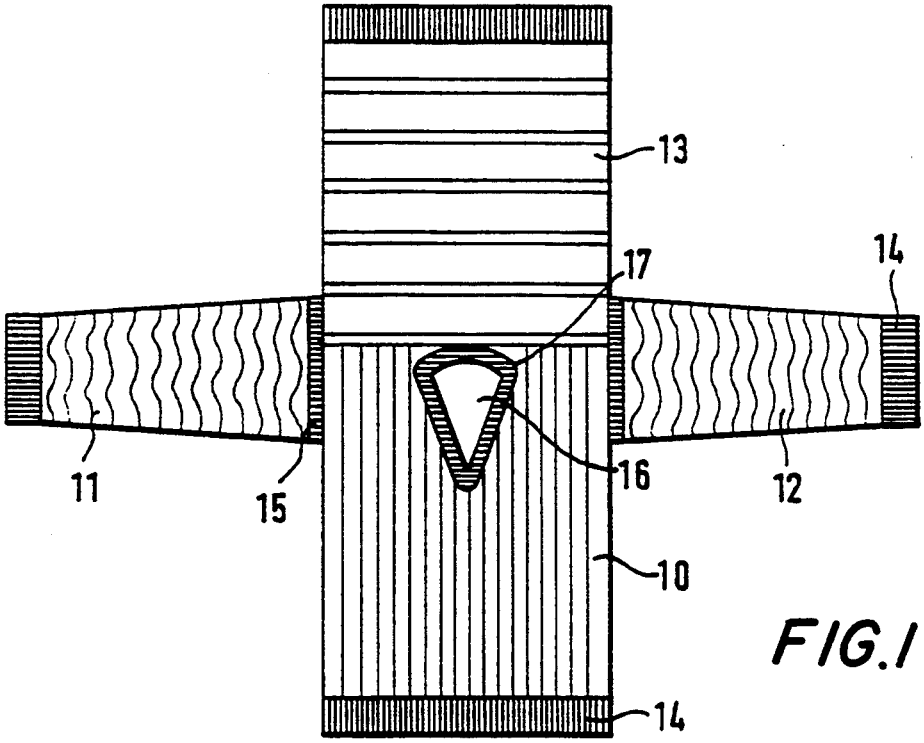
FIG. 1 is a schematic plan view of a flat knitted article produced in accordance with a method of the present invention.

A flat knitted article for a sweater produced in accordance with the inventive method as shown in FIG. 1 is subdivided into two knitted articles: a front part 10, two sleeves 11 and 12 and a rear part 13. Each of the parts 10–13 has a different jaquard pattern. At their ends, the parts 11–13 are closed correspondingly by a rib edge 14. The sleeves 11 and 12 are placed directly on the front part 10 and the rear part 13, and the placement areas are emphasized by pipings 15. The pipings 15 are produced by forming hose-like knitted pieces on the connections of the sleeves 11 and 12. In the shoulder region between the front part 10 and the rear part 13, a V-opening 16 is formed and surrounded by a small standing band 17. For producing the sweater the front part 10 and the rear part 13 are connected with one another by lateral seams which extend through the shoulder opening and connect the sleeves 11 and 12 at the lower side.

Figure 2:
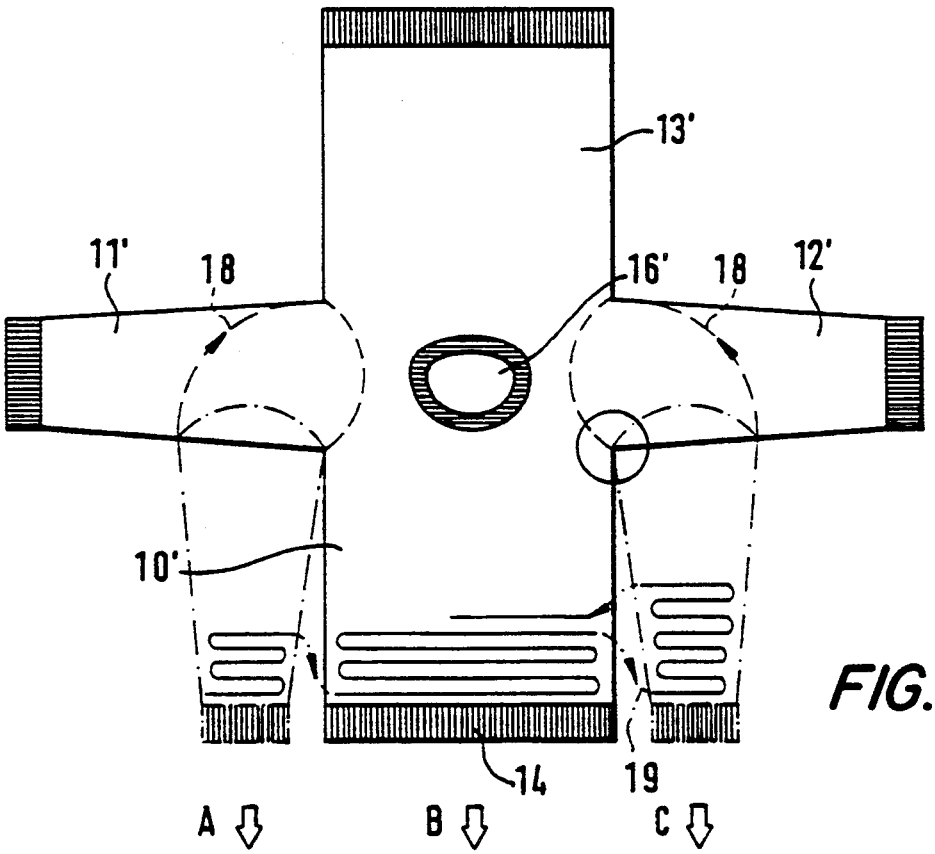
FIG. 2 is a schematic plan view of a second flat knitted article produced in accordance with the method of the present invention, in which the formation of the loop row of the knitted article is identified.

FIG. 2 shows a second example of a flat knitted article for a long-armed sweater. In contrast to the sweater shown in FIG. 1, the flat knitted article in FIG. 2 has a round neck opening 16' and sleeves 11' and 12' which are provided with a spherical connection identified in FIG. 2 by a dashed line. Dashed-dotted lines identify the position of both sleeve parts 11' and 12' when they are located in the flat knitting machine during their joint production with the front part 10'. After producing both sleeve parts 11' and 12', they are turned during the production of the front part and the beginning of the rear part 13' inwardly against these parts and connected with them by seams until they reach the position shown with solid lines in FIG. 2. The process of turning in and seam connecting of the sleeves 11' and 12' is identified in FIG. 2 by dashed-arrow lines 18. Moreover, the loop row formation of both sleeves 11' and 12' as well as the front part 10' are identified by arrow lines 19. After the simultaneous knitting of the rib edge 14' for the parts 11', 10' and 12' with separate thread guides A, B and C, several loop rows of the sleeve 11' are finally produced before the same number of loop rows of the front part 10' are finished. Subsequently, the double number of loop rows of the sleeve 12' is knitted and then the front part 10' is further knitted to the same height and this process correspondingly advances.

The knitting of several loop rows of a knitted part before transferring to a next knitted part insures a uniform patterning of the individual parts, and is also useful when each knitted part 11', 10' and 12' has a different pattern. Therefore, with the inventive method the patterning of the individual knitted parts can be performed without any limits.

The sleeves 11' and 12' and the front part 10' are finished until reaching the shoulder hollow together in the manner shown by the arrow line 19 on the flat knitting machines. After reaching the shoulder hollow the sleeves 11' and 12' are finished by forming the spherical arm connection, while the front part 10' is not knitted during this time. The knitting pause is provided during transferring of the needle region to the front part 10' by the carriage. It is used to perform a needle bed displacement required for patterning. In this way the manufacturing time for the flat knitted article can be reduced. After finishing the sleeves 11' and 12', the front part 10' is finished with simultaneous tying of the loops of the sleeve connecting edges. The tying of the loops of the sleeve connecting edges is performed by known processes.

Figure 2A:
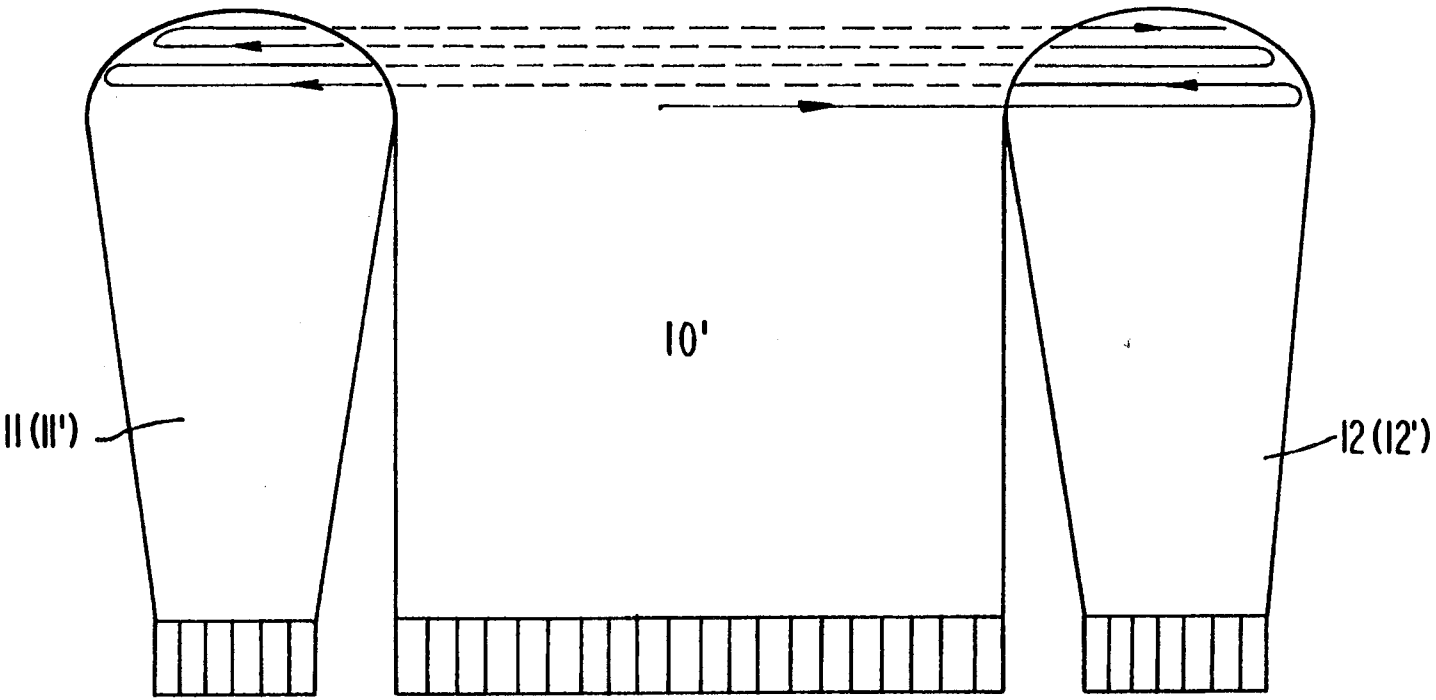
FIG. 2*a* is a view schematically showing a further knitting of sleeves alone of the flat knitted articles, in which an upper sleeve connection extending through at least one loop row is formed while on a front part of the article no loop formation is performed.

FIG. 2*a* schematically illustrates knitting of the sleeves 11 (11') and 12 (12') alone. The upper sleeve connection can extend in a pattern through at least one loop row or several loop rows, while on the front part 10 (10') no loop formation is performed. The knitting of the sleeves can include piping or forming an arm sphere. The dotted lines mark a movement of the carriage without knitting.

Figure 3:
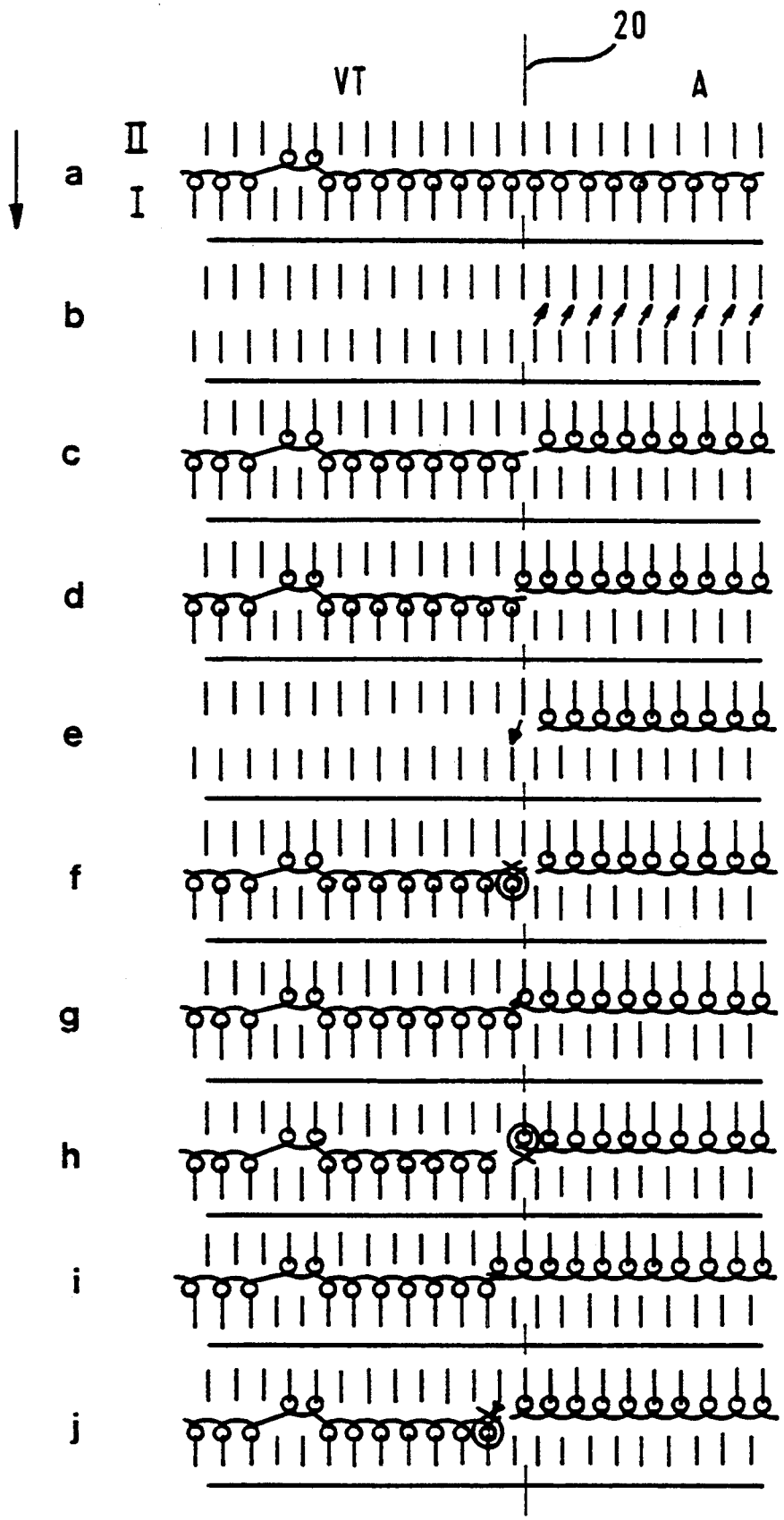
FIG. 3 is a view showing a thread course for forming the arm opening marked in FIG. 2.

The required reduction of the loop number of the front part for receiving the spherical connection of the sleeves 11' and 12' with simultaneous tying of the loops of the shoulder connection edge is shown in FIG. 3 for the region of the front part 10' for receiving the sleeve 12' as marked in FIG. 2 with a circle. This Figure shows subsequent steps from above downwardly for the manufacture of the loop rows of the transition region between the front part 10' and the sleeve 12'. The loop rows are identified in line row pairs, of which the upper line row symbolizes correspondingly the rear needle bed II and the lower line row symbolizes the front needle bed I. The needle beds I and II are subdivided by a dashed-dotted line 20 in the upper region into a region VT for the loops of the front part and a region A for the sleeve loops. In the position "a", in the region VT loops of the front part 10' are shown, and they are partially located on the needle bed I and partially on the needle bed II. At the right side of the line 20, the loops of a left closing row of the sleeve 12' is shown lying on the needle bed I. In the position "b", the loops of the sleeve 12' are transferred from the needle bed I to the needle bed II, so that in the position "c" the shown distribution of the loops of the sleeve 12' and the front part 10' on both needle beds I and II is obtained. In the position "d" a displacement of the needle bed II by a needle pitch to the left is performed, so that the right outer loop of the front part and the left outer loop of the sleeve 12' lie one behind the other. Thus the left outer loop of the sleeve 12' is transferred to the needle bed I as is shown in the position "e", whereby the loop formation in accordance with the position "f" is produced. The left outermost loops of the sleeve 12' are transferred together with the right outermost loops of the front part 10' to a needle. In the position "g" the tying of these double loops and the return transfer of the tied loops to the needle bed II is performed. The distribution of the loops shown in the position "h" is produced. In the position "i" again a displacement of the needle bed II relative to the needle bed I is performed to the left by a needle pitch. Subsequently again the left outer loops of the sleeve 12' are transferred to the outermost right loops of the front part 10' on the needle bed I as shown in the position "j", before the process from the position "g" is repeated until the front part 10' is reduced by the required number of loops. During knitting of the rear part 13' the loops are again produced until the initial width of the knitted article is again obtained.

Figure 4:
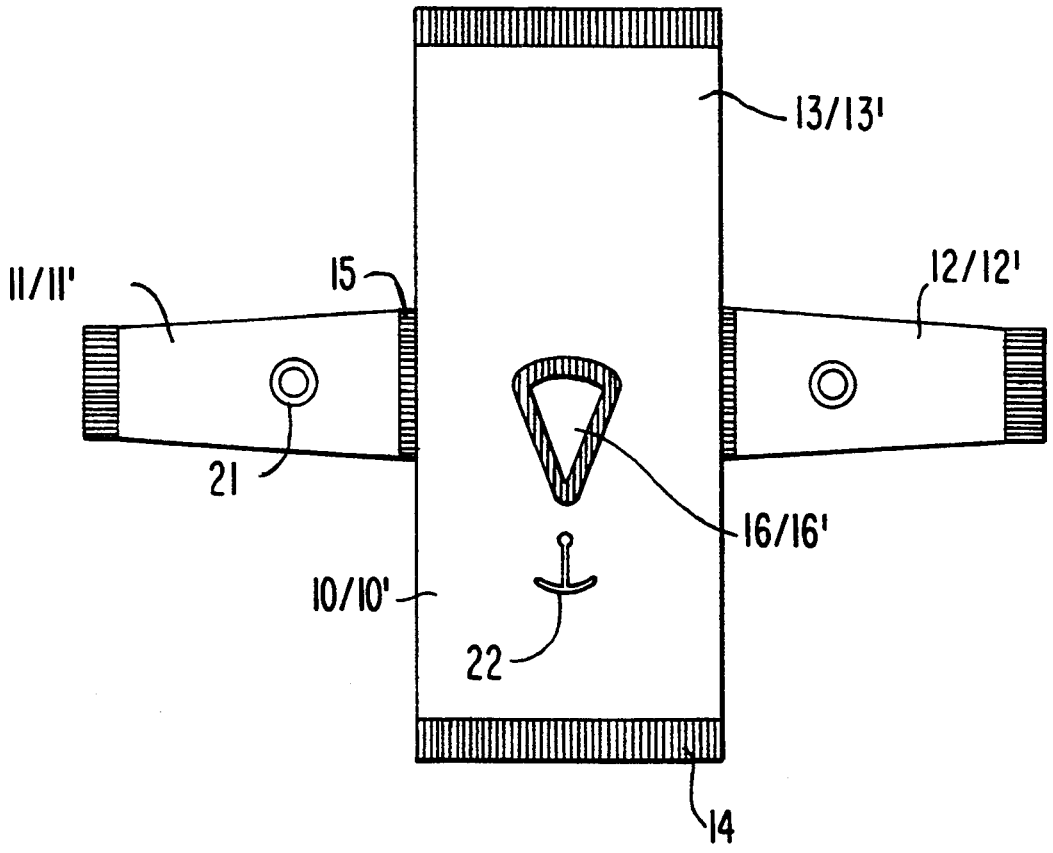
FIG. 4 shows the step of knitting of logos and labels in the flat knitted article in accordance with the inventive method.

FIG. 4 shows that additional elements can be knitted-in in the knitted article part, for example letters 21 forming a company logo, labels 22, etc. Also, this Figure illustrates that ends of the knitted article part can be provided with loop-fixed edges.

It will be understood that each of the elements described above, or two or more together, may also find a useful application in other types of methods differing from the types described above.

While the invention has been illustrated and described as embodied in a method of producing a fashioned, one-piece flat knitted article, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of producing a fashioned, one-piece flat knitted article for a garment provided with sleeves on a two-bad flat knitting machine with at least one carriage, a needle bed displacement device, a loop changing device and a pattern device, wherein individual knitted article parts are to be knitted with separate thread guides, the method comprising the steps of knitting several knitted article parts including a front part, a rear part and two sleeves separately and sequentially so that in each knitted article part always several loop rows are knitted in accordance with a pattern for said each knitted article part before transferring to a next knitted article part; after finishing the sleeves, knitting the front part and a shoulder region of any shape and pattern with the formation of an arbitrarily shaped neck opening between the front part and the rear part; transferring connecting rows of the sleeves in a loop-like manner inwardly in a direction of the shoulder region and the front and rear parts until sleeve connecting edges are completely turned inwardly relative to the front part and rear part; and subsequently finally knitting a last knitted article part in correspondence with a pattern for said last knitted article part.

2. A method as defined in claim 1, wherein said step of finally knitting includes knitting of the rear part.

3. A method as defined in claim 1, wherein said knitting includes knitting of the sleeves alone.

4. A method as defined in claim 1, wherein said step of knitting the sleeves alone includes forming an upper sleeve connection extending in a pattern through at least one loop row while on the front part no loop formation is performed.

5. A method as defined in claim 4, wherein said step of knitting the sleeves alone includes forming the upper sleeve connection extending over several loop rows.

6. A method as defined in claim 3, wherein said step of knitting the sleeves alone includes piping.

7. A method as defined in claim 3, wherein said step of knitting the sleeves alone includes forming an arm sphere.

8. A method as defined in claim 3, wherein said step of knitting the sleeves alone includes performing a needle bed displacement, and moving the carriage over a needle region for the front part without knitting loops of the front part.

9. A method as defined in claim 1; and further comprising the steps of forming an arm opening in the front part by transferring the loops of the sleeve closed with a left loop row to a second needle bed, then displacing the second needle bed relative to a first needle bed by a needle pitch in direction toward the front part; transferring the outermost loops of the sleeve facing the front part to the needle of the outermost loops of the front part and tying them together; and transferring to the second needle bed; and repeating this process frequently until the front part diminishes by a desired number of loops.

10. A method as defined in claim 1, wherein said knitting includes knitting with intarsia thread guides.

11. A method as defined in claim 1; and further comprising the step of knitting-in a row of letters in the knitted article parts.

12. A method as defined in claim 1; and further comprising the step of knitting-in company logos in the knitted article parts.

13. A method as defined in claim 1; and further comprising the step of knitting-in labels in the knitted article parts.

14. A method as defined in claim 1; and further comprising the step of providing ends of the knitted article parts with loop-fixed edges.

* * * * *